US008608516B2

(12) United States Patent
Huang

(10) Patent No.: US 8,608,516 B2
(45) Date of Patent: Dec. 17, 2013

(54) ELECTRICAL CONNECTOR TERMINAL HAVING A PLURALITY OF RESILIENT MEMBERS

(75) Inventor: Min-Shrong Huang, Changhua County (TW)

(73) Assignee: K.S. Terminals Inc., Xianxi Township, Changhua County (TW)

( * ) Notice: Subject to any disclaimer, the term of this patent is extended or adjusted under 35 U.S.C. 154(b) by 49 days.

(21) Appl. No.: 13/195,327

(22) Filed: Aug. 1, 2011

(65) Prior Publication Data

US 2012/0329339 A1 Dec. 27, 2012

(30) Foreign Application Priority Data

Jun. 21, 2011 (TW) ..... 100211190 A

(51) Int. Cl.
*H01R 13/42* (2006.01)

(52) U.S. Cl.
USPC ..... 439/751; 439/856

(58) Field of Classification Search
USPC ..... 439/82, 751, 856, 857
See application file for complete search history.

(56) References Cited

U.S. PATENT DOCUMENTS

| | | | | | |
|---|---|---|---|---|---|
| 4,701,004 | A | * | 10/1987 | Yohn | 439/871 |
| 4,865,558 | A | * | 9/1989 | Stoner | 439/246 |
| 4,894,031 | A | * | 1/1990 | Damon et al. | 439/885 |
| 5,147,227 | A | * | 9/1992 | Yurko | 439/733.1 |
| 5,362,244 | A | * | 11/1994 | Hanson et al. | 439/82 |
| 5,389,013 | A | * | 2/1995 | Kourimsky | 439/746 |
| 5,509,814 | A | * | 4/1996 | Mosquera | 439/82 |
| 5,611,716 | A | * | 3/1997 | Egenolf | 439/857 |
| 5,873,754 | A | * | 2/1999 | Hotea | 439/843 |
| 7,527,533 | B2 | * | 5/2009 | Lappoehn | 439/751 |

* cited by examiner

*Primary Examiner* — Thanh Tam Le
(74) *Attorney, Agent, or Firm* — Muncy, Geissler, Olds & Lowe, PLLC

(57) ABSTRACT

An electrical connector terminal is provided. The electrical connector terminal has axially aligned sections including a contact section and a connecting section away from the contact section. The connecting section is circumferentially formed with a plurality of axially extending resilient members, each having a thickness T and a width W that satisfy the relationship of 1.5T<W<6T. The resilient members are formed in accordance with the thickness-width relationship to enhance the strength of contact. The number of the resilient members is also selected according to the thickness-width relationship to increase the area of contact. Thus, the electrical connector terminal can be inserted securely into an electrical connector and, once inserted, is unlikely to be easily pulled out of the electrical connector.

9 Claims, 9 Drawing Sheets

ELECTRICAL CONNECTOR TERMINAL HAVING A PLURALITY OF RESILIENT MEMBERS

BACKGROUND OF THE INVENTION

1. Technical Field

The present invention relates to an electrical connector terminal for use with an electrical connector. More particularly, the present invention relates to an electrical connector terminal which can be inserted firmly into an electrical connector and, once inserted, is unlikely to be easily pulled out of the electrical connector.

2. Description of Related Art

Connecting devices for use in signal and/or electricity transmission and their fittings are generally referred to as electrical connectors. Nowadays, electrical connectors are extensively used in different industries so that the desired signals and/or electric power can be transmitted rapidly.

In order to connect a cable to an electrical connector, an electrical connector terminal coupled with the cable is inserted into the electrical connector, which in turn provides protection for the terminal. While there are a good number of factors that influence the quality of an electrical connector, the key factor lies in the secureness of engagement between the connector and the terminal.

Please refer to FIG. 1 for a conventional electrical connector terminal 30 to be engaged in an electrical connector by means of a plurality of resilient members 31. The resilient members 31—each having a cantilever configuration—must not be too long; otherwise, the resilient members 31 are subject to deformation which will compromise the strength of contact. Should the resilient members 31 be deformed, the terminal 30 is very likely to get loose and have problem engaging with the electrical connector firmly. Such incomplete engagement between the terminal 30 and the electrical connector tends to aggravate if the inner periphery of the electrical connector has a less than perfect circularity attributable to the processing process. In an extreme case, the terminal 30 and the cable coupled thereto may be exposed from and thus left unprotected by the electrical connector.

Hence, it is an important research and development goal in the related industries to overcome the aforementioned drawbacks of the conventional electrical connector terminals and design an improved electrical connector terminal that can be inserted securely into an electrical connector and, once inserted, cannot be easily pulled out.

BRIEF SUMMARY OF THE INVENTION

In order to overcome the foregoing drawbacks of the prior art, the present invention provides an electrical connector terminal as disclosed herein. The disclosed electrical connector terminal is formed as a hollow tube and has axially aligned sections including a contact section and a connecting section away from the contact section. The connecting section is circumferentially formed with a plurality of axially extending resilient members. Each resilient member has a connected end connected to the connecting section and a free end deflected radially outward to form an opening on the connecting section. The free ends of the plural resilient members jointly form a circle. In addition, each resilient member has a thickness T and a width W that satisfy the relationship of $1.5T<W<6T$.

In the disclosed electrical connector terminal, the thickness of each resilient member ranges from 0.3 mm to 0.5 mm, and the width of each resilient member ranges from 0.45 mm to 3.0 mm.

In the disclosed electrical connector terminal, the spacing between each two adjacent resilient members ranges from 0.45 mm to 3.0 mm.

In the disclosed electrical connector terminal, the axial length between the connected end and the free end of each resilient member ranges from 0.8 mm to 5.0 mm.

In the disclosed electrical connector terminal, the number of the resilient members ranges from 2 to 10 and is preferably three.

In the disclosed electrical connector terminal, the outer diameter of the connecting section is between 5.0 mm and 5.6 mm.

In the disclosed electrical connector terminal, the circle formed by the free ends of the plural resilient members has a diameter between 6.0 mm and 7.0 mm.

The disclosed electrical connector terminal is integrally formed of a metal plate, and a gap is formed between each of the two lateral sides of each resilient member and the corresponding one of the two lateral sides of the corresponding opening. Moreover, each resilient member has a bent portion between its connected end and free end.

Therefore, the primary object of the present invention is to provide an electrical connector terminal having resilient members, wherein each resilient member is formed according to the thickness (T)-width (W) relationship of $1.5T<W<6T$. As such, the resilient members are less likely to deform and are capable of an increased strength of contact with an electrical connector. This allows the electrical connector terminal to be inserted securely into the electrical connector and will not be easily pulled out of the electrical connector easily.

It is another object of the present invention to provide an electrical connector terminal having resilient members, wherein the number of the resilient members is selected according to the thickness (T)-width (W) relationship of $1.5T<W<6T$. Thus, all the resilient members can engage firmly with an electrical connector, and the area of contact between the resilient members and the electrical connector is increased. In consequence, the electrical connector terminal is securely insertable into the electrical connector and, once inserted, cannot be pulled out of the electrical connector easily.

BRIEF DESCRIPTION OF THE SEVERAL VIEWS OF THE DRAWINGS

The structure as well as a preferred mode of use, further objects, and advantages of the present invention will be best understood by referring to the following detailed description of the preferred embodiments in conjunction with the accompanying drawings, in which.

Figure 1:
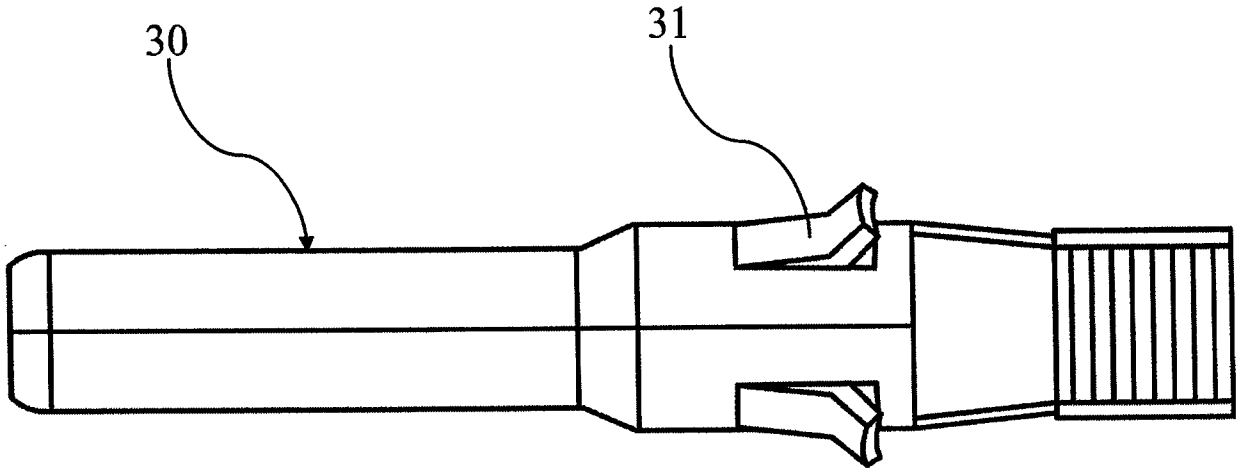
Fig.1 (Prior Art)
FIG. 1 is a top view of a conventional electrical connector terminal.
Figure 2:
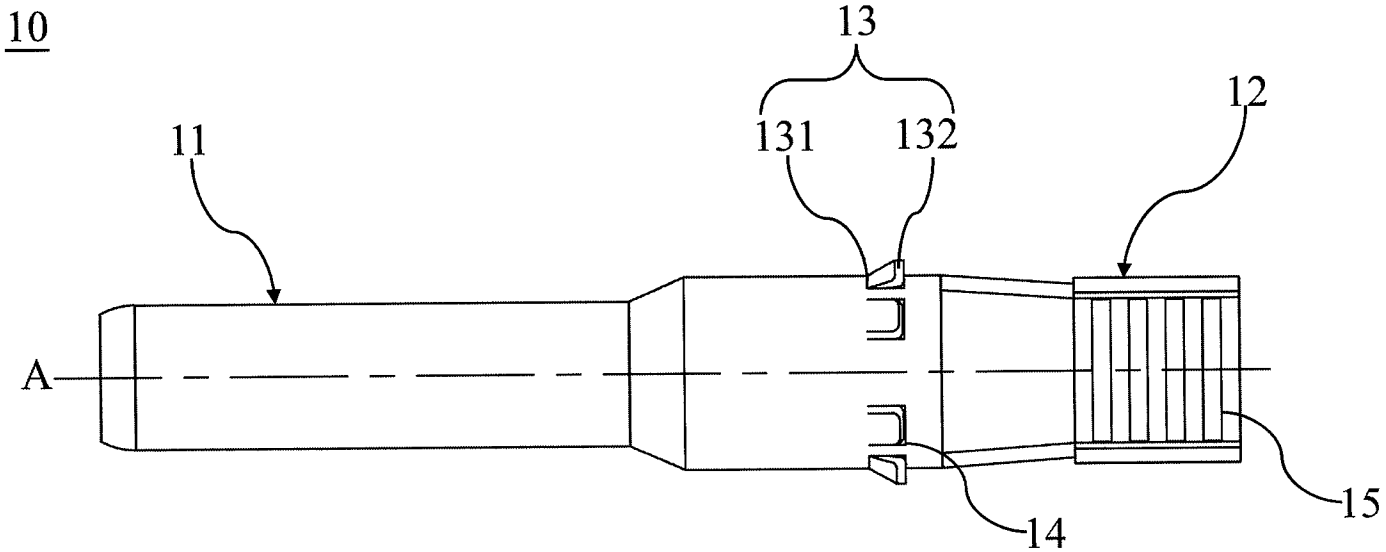
FIG. 2 is a top view of an electrical connector terminal according to the first preferred embodiment of the present invention.
Figure 5:
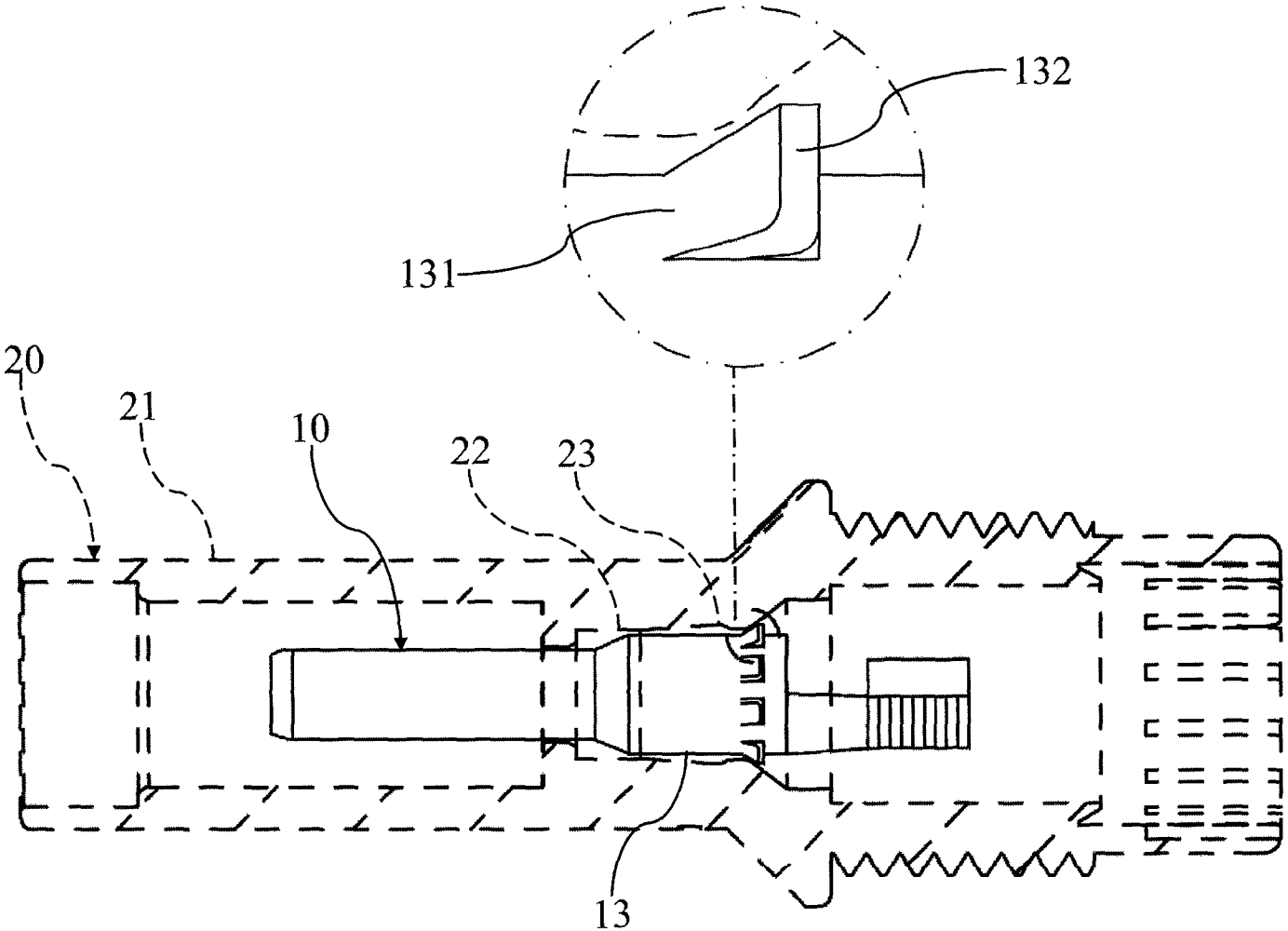
FIG. 5 is an assembled view and a partial enlarged view thereof of the electrical connector terminal depicted in FIG. 2 and an electrical connector, wherein the electrical connector terminal has yet to be fully engaged with the electrical connector.
Figure 6:
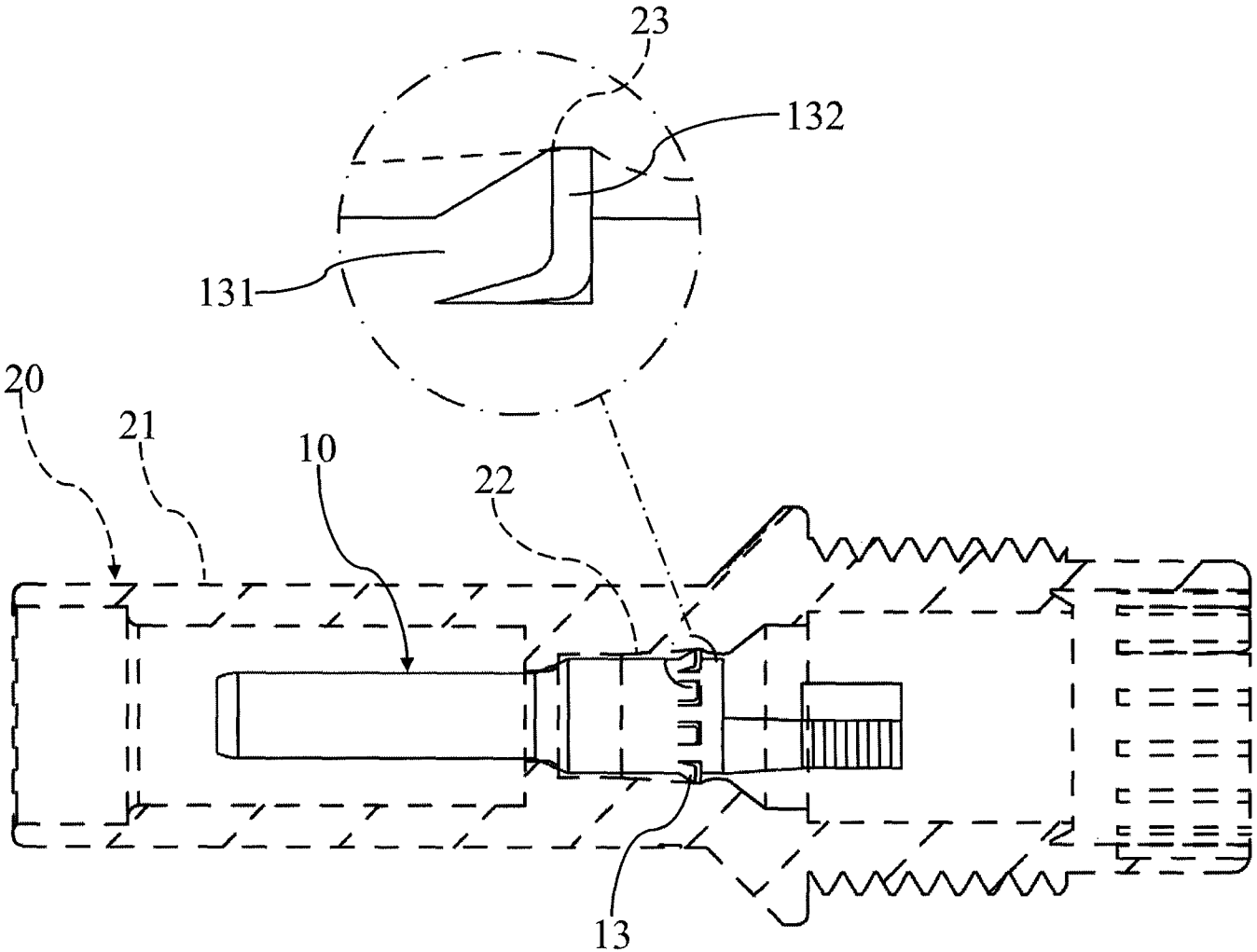
Figure 7:
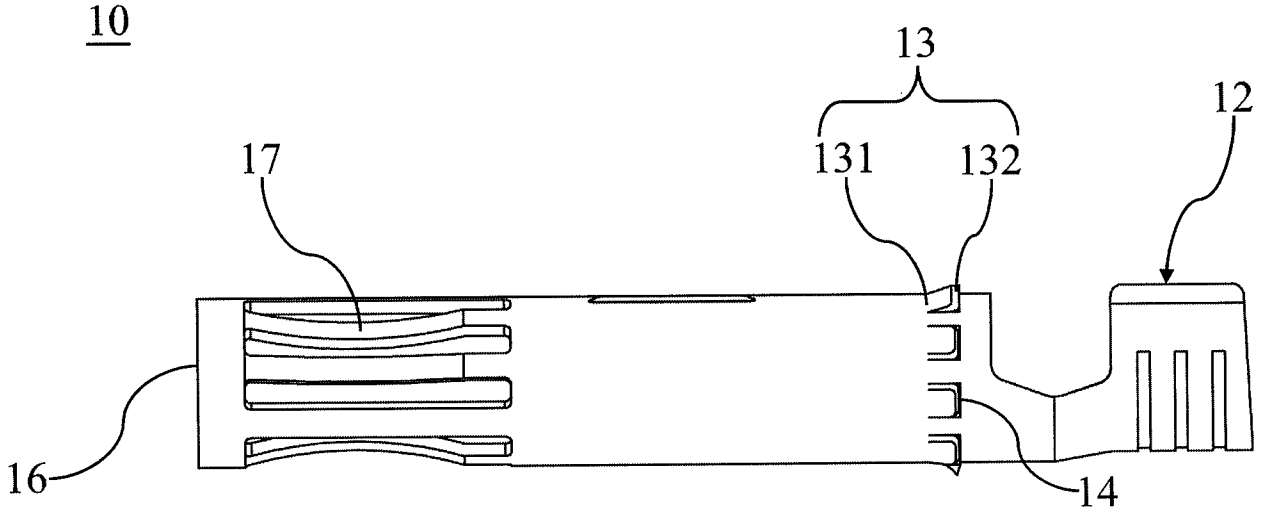
Figure 8:
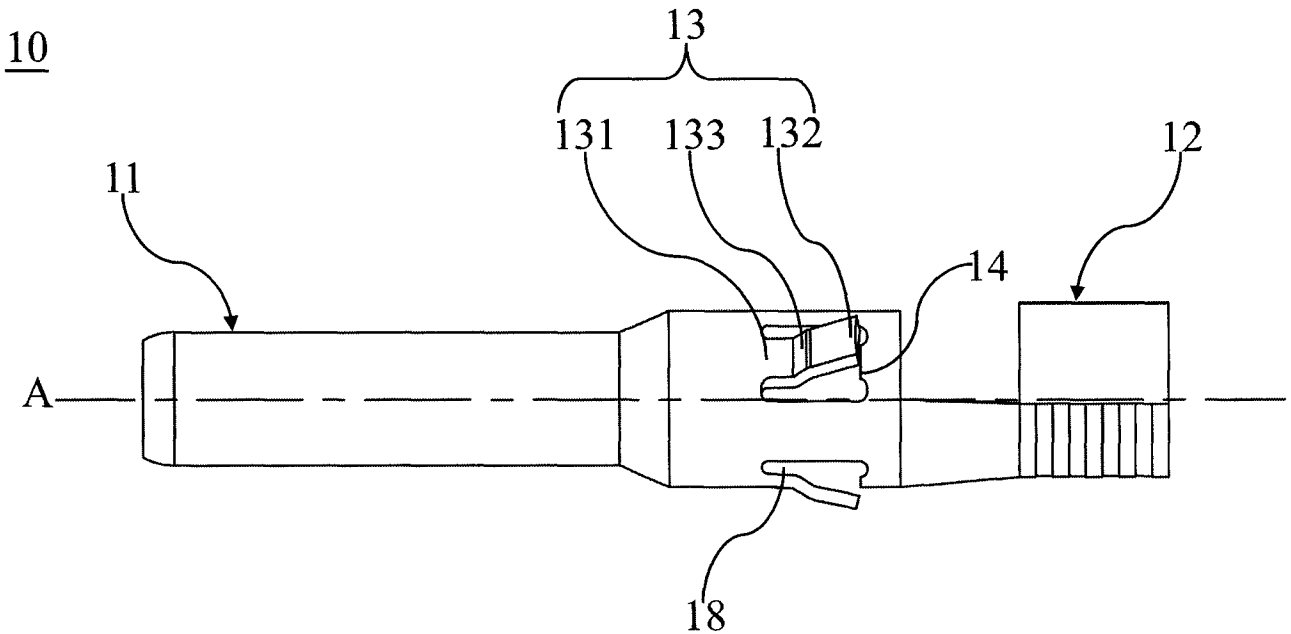
Figure 9:
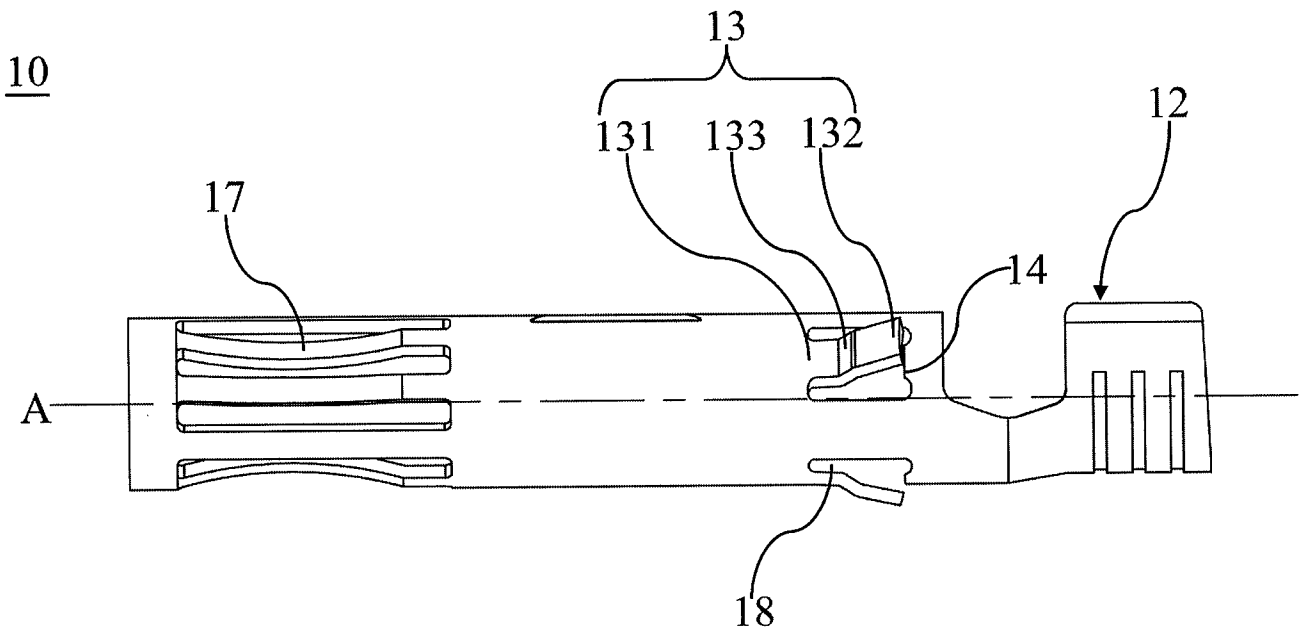

FIG. 6 is another assembled view and a partial enlarged view thereof of the electrical connector terminal depicted in FIG. 2 and the electrical connector depicted in FIG. 5, wherein the electrical connector terminal is fully engaged with the electrical connector;

FIG. 7 is a top view of an electrical connector terminal according to the second preferred embodiment of the present invention;

FIG. 8 is a top view of an electrical connector terminal according to the third preferred embodiment of the present invention, wherein the electrical connector terminal has three resilient members; and FIG. 9 is a top view of an electrical connector terminal according to the fourth preferred embodiment of the present invention, wherein the electrical connector terminal has three resilient members.

DETAILED DESCRIPTION OF THE INVENTION

The present invention discloses an electrical connector terminal, wherein the principle employed of signal and/or electricity transmission between an electrical connector terminal and an electrical connector is well known to a person of ordinary skill in the art and therefore will not be detailed herein. Besides, the drawings referred to in the following description are not drawn according to actual dimensions and need not be so because they are intended to demonstrate the features of the present invention only schematically.

Referring to FIG. 2, an electrical connector terminal 10 according to the first preferred embodiment of the present invention is integrally formed of a metal plate and has an axis A. The axial direction of the electrical connector terminal 10 is defined as the direction parallel to the axis A; and the radial direction, as the direction perpendicular to the axis A. As shown in FIG. 2, the electrical connector terminal 10 has a contact section 11 and a connecting section 12 lined up along the axial direction of the electrical connector terminal 10. The connecting section 12 is away from the contact section 11 and is circumferentially formed with a plurality of axially extending resilient members 13 which are spaced from each other. Each resilient member 13 has a connected end 131 and a free end 132 away from the connected end 131. The connected end 131 of each resilient member 13 is connected to the connecting section 12, while the free end 132 of each resilient member 13 is deflected radially outward to form an opening 14 on the connecting section 12.

Figure 3:
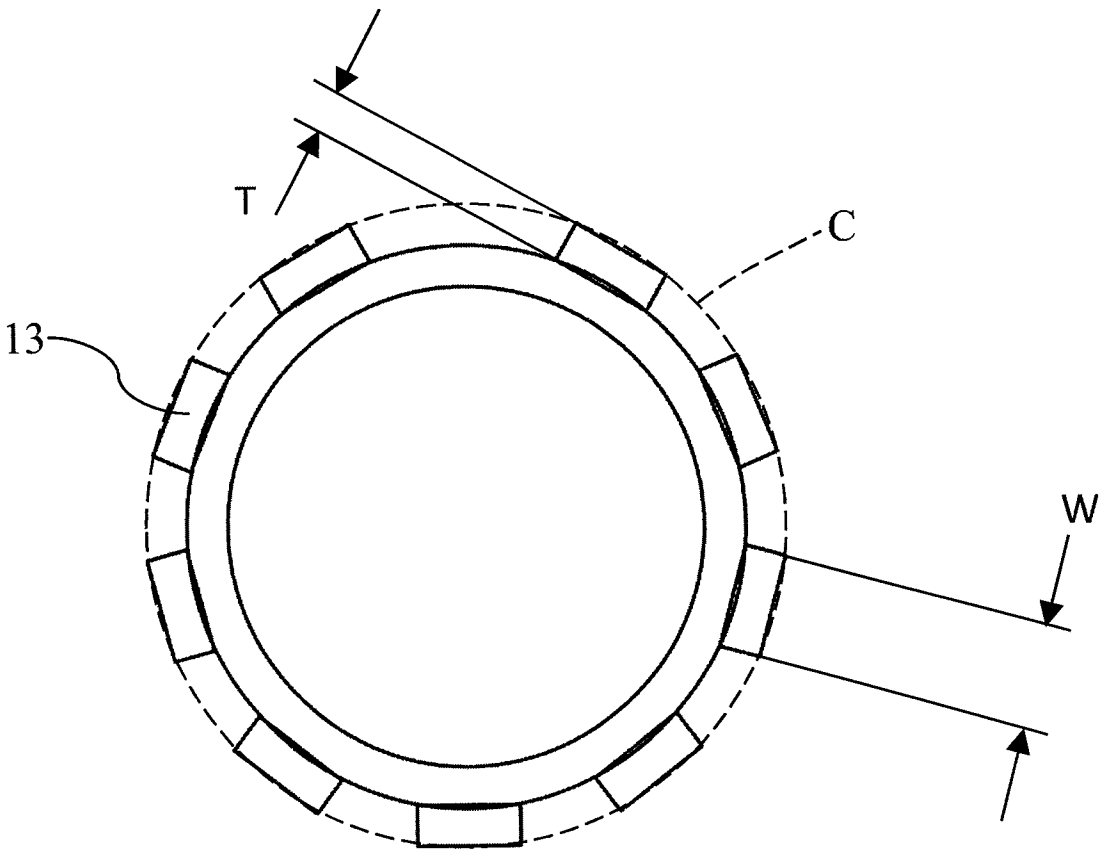
FIG. 3 is a sectional view of the electrical connector terminal depicted in FIG. 2.
Figure 4:
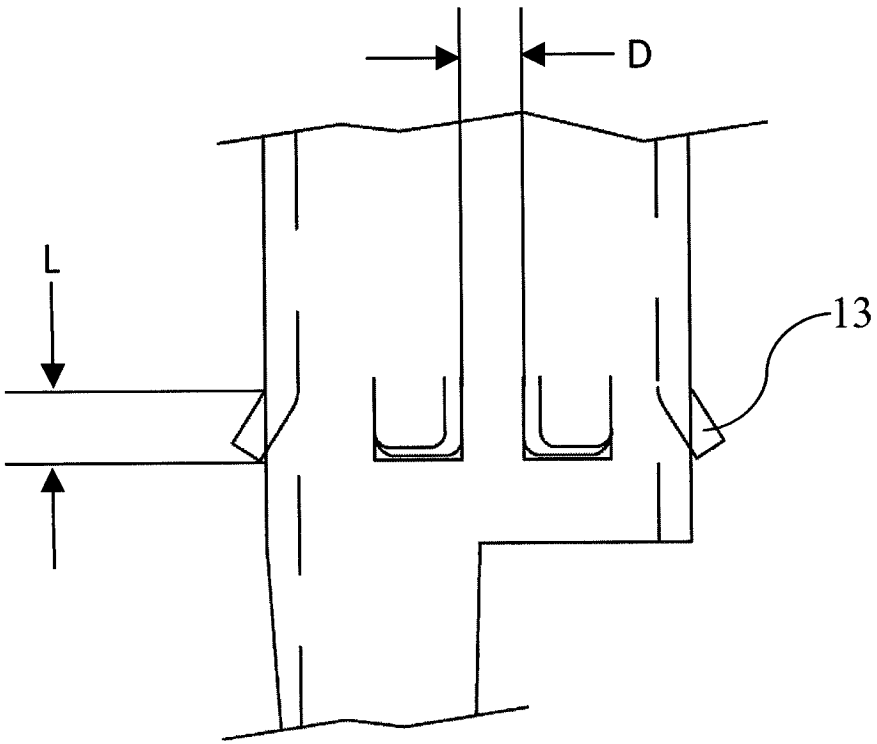
FIG. 4 is a partial view of the electrical connector terminal depicted in FIG. 2.

Please refer to FIG. 3 for a sectional view of the electrical connector terminal 10. The electrical connector terminal 10 is a hollow tube, and each resilient member 13 has a thickness T and a width W that satisfy the relationship of $1.5T<W<6T$. The free ends 132 of the resilient members 13 form a circle C centered at the axis A. More specifically, the circle C is formed by the radially outermost edge of the free end 132 of each resilient member 13. Referring to FIG. 4 for a partial view of the electrical connector terminal 10, the axial length L from the connected end 131 to the free end 132 of each resilient member 13 is in direct proportion to the circumference of the circle C formed by the free ends 132 of the resilient members 13.

The inventor of the present invention has found after repeated experiments that the number of the resilient members 13 is preferably between 2 and 10 and is most preferably three. As long as the number of the resilient members 13 does not exceed 10, a sufficient area of contact between the electrical connector terminal 10 and a matching electrical connector 20 (see FIGS. 5 and 6) is ensured upon engagement therebetween, even if the electrical connector 20 is so processed that its inner periphery is not a proper circle. However, if there are more than 10 resilient members 13, the width W of each resilient member 13 must be reduced, given the limited circumference of the circle C. While the area of contact between the resilient members 13 and the electrical connector 20 increases with the number of the resilient members 13, the structural strength of each resilient member 13 decreases with the width W.

According to the present invention, the electrical connector terminal 10 has the following specifications. Referring back to FIG. 3, the thickness T of each resilient member 13 is between 0.3 mm and 0.5 mm; and the width T, between 0.45 mm and 3.0 mm. The diameter of the circle C formed by the free ends 132 of the resilient members 13 ranges from 6.0 mm and 7.0 mm. Referring to FIG. 4, the distance D between each two adjacent resilient members 13 ranges from 0.45 mm to 3.0 mm. The axial length L from the connected end 131 to the free end 132 of each resilient member 13 is between 0.8 mm and 5.0 mm. The connecting section 12 of the electrical connector terminal 10 has an outer diameter between 5.0 mm and 5.6 mm.

Reference is now made to FIG. 5, in which the electrical connector terminal 10 is used with, inserted into, but not fully engaged with the waterproof electrical connector 20. The waterproof electrical connector 20 includes an insulating housing 21 that is formed with an inner hole 22. Provided at appropriate positions on the wall of the inner hole 22 are a plurality of positioning grooves 23. Referring also to FIG. 6, which shows the electrical connector terminal 10 fully engaged in the inner hole 22 of the waterproof electrical connector 20, the free ends 132 of the resilient members 13 of the electrical connector terminal 10 press against the positioning grooves 23 of the insulating housing 21 respectively. Although the positioning grooves 23 on the wall of the inner hole 22 form a smaller circle than the circle C formed by the free ends 132 of the resilient members 13, the elasticity of the free ends 132 of the resilient members 13 allows the resilient members 13 to move easily past the circle formed by the positioning grooves 23. Once moved past the circle formed by the positioning grooves 23, each resilient member 13 presses against the side of the corresponding positioning groove 23 that is adjacent to the contact section 11, making it difficult to pull the electrical connector terminal 10 backward out of the waterproof electrical connector 20. Moreover, with the diameter of the inner hole 22 of the waterproof electrical connector 20 being 0.1 mm to 0.7 mm less than the diameter of the circle C, the electrical connector terminal 10 is inserted securely in the waterproof electrical connector 20 and prevented from being pulled out of the waterproof electrical connector 20.

The electrical connector terminal 10 in the first preferred embodiment of the present invention is formed as a male terminal, wherein the connecting section 12 of the electrical connector terminal 10 has an aperture 15 for connecting with the core of a cable. Nevertheless, the electrical connector terminal 10 can also be formed as a female terminal, as shown in FIG. 7 as the second preferred embodiment of the present invention. The second preferred embodiment is different from the first preferred embodiment in that the contact section 11 of the electrical connector terminal 10 shown in FIG. 7 has a through hole 16 in communication with the aperture 15 and is circumferentially formed with a plurality of axially extending second resilient members 17 that curve toward the axis A. The through hole 16 is so designed that an electrical connector terminal 10 configured as a male terminal can be inserted into the through hole 16 and be clamped by the second resilient members 17.

Hence, by controlling the width W and thickness T of each resilient member 13 of the disclosed electrical connector terminal 10 to conform to the relationship of 1.5T<W<6T, all the resilient members 13 are engageable with the electrical connector 20 and less deformable. As both the strength and area of contact between the resilient members 13 and the electrical connector 20 are increased, the electrical connector terminal 10 can remain securely inserted in and will not be easily pulled out of the electrical connector 20.

FIG. 8 illustrates further improvements made to the resilient members 13 and the openings 14 of the male terminal in the first preferred embodiment; and FIG. 9, of the female terminal in the second preferred embodiment. The electrical connector terminals 10 depicted in FIGS. 8 and 9 are the third and the fourth preferred embodiments of the present invention respectively and each have three resilient members 13.

In the third and the fourth preferred embodiments, the width W of each resilient member 13 ranges from 1.6 mm to 2.4 mm and is preferably 2.2 mm. The axial length L of each resilient member 13 ranges from 2.5 mm to 4.5 mm and is preferably 3.0 mm. The distance D between each two adjacent resilient members 13 ranges from 1.5 mm to 3.0 mm and is preferably 1.7 mm. The diameter of the circle C formed by the free ends 132 is 6.6 mm. The outer diameter of the connecting section 12 of each electrical connector terminal 10 is 5.3 mm.

In the third and the fourth preferred embodiments, a gap 18 is formed between each of the two lateral sides of each resilient member 13 and the corresponding one of the two lateral sides of the corresponding opening 14. Each gap 18 is longer than the axial length L of the corresponding resilient member 13 and has a width ranging from 0.4 mm to 1.0 mm and preferably equal to 0.6 mm. As the resilient members 13 will be compressed upon engagement with the electrical connector 20 and then spring back, the provision of the gaps 18 is to prevent the resilient members 13 from interfering with the corresponding openings 14 during the compression and spring-back process. Each resilient member 13 in the third and the fourth preferred embodiments is further formed with a bent portion 133 between the connected end 131 and the free end 132. The bent portions 133 have a bent configuration for enhancing the structural strength of the resilient members 13.

While the present invention is described herein by reference to its preferred embodiments, it is understood that the embodiments are not intended to limit the scope of the present invention. Moreover, as the contents disclosed herein should be readily understandable and can be implemented by a person of ordinary skill in the art, all equivalent changes or modifications which do not depart from the spirit of the present invention should be encompassed by the appended claims.

What is claimed is:

1. A waterproof electrical connector, comprising an insulating housing (21) and an electrical connector terminal (10), wherein the electrical connector terminal (10) being formed as a hollow tube and having axially aligned sections, the terminal comprises a contact section (11) and a connecting section (12) away from the contact section (11), the connecting section (12) being circumferentially provided with a plurality of axially extending resilient members (13), each resilient member (13) having a connected end (131) and a free end (132), wherein the connected end (131) is connected to the connecting section (12) and the free end (132) is deflected radially outward to form an opening (14) on the connecting section (12), wherein all of the plural resilient members (13) are engageable with the waterproof electrical connector, wherein the free ends (132) of the plural resilient members (13) form a circle (C), and said each resilient member (13) has a thickness T and a width W that satisfy the relationship of 1.5T W 6T, wherein an axial length L from the connected end (131 to the free end (132) of said each resilient member (13) is in direct proportion to the circumference of the circle (C) formed by the free ends (132), wherein the electrical connector terminal (10) is disposed in the insulating housing (21) and the insulating housing (21) has an inner hole (22) being 0.1 mm to 0.7 mm less in diameter than the circle (C) formed by the free ends (132) of the resilient members (13) of the electrical connector terminal (10) and a plurality of positioning grooves, and wherein when the electrical connector terminal is fully engaged with the electrical connector, the free ends press against the positioning grooves to lock the electrical terminal into the waterproof electrical connector.

2. The waterproof electrical connector of claim 1, wherein the thickness (T) of each said resilient member (13) ranges from 0.3 mm to 0.5 mm, and the width (W) of each said resilient member (13) ranges from 0.45 mm to 3.0 mm.

3. The waterproof electrical connector of claim 2, wherein each two adjacent said resilient members (13) is spaced by a distance (D) ranging from 0.45 mm to 3.0 mm.

4. The waterproof electrical connector of claim 3, wherein each said resilient member (13) has an axial length (L) between the connected end (131) and the free end (132) that ranges from 0.8 mm to 5.0 mm.

5. The waterproof electrical connector of claim 1, wherein the number of the resilient members (13) ranges from 2 to 10.

6. The waterproof electrical connector of claim 5, wherein the number of the resilient members (13) is three.

7. The waterproof electrical connector of claim 1, wherein the connecting section (12) has an outer diameter ranging from 5.0 mm to 5.6 mm.

8. The waterproof electrical connector of claim 7, wherein the circle (C) formed by the free ends (132) of the plural resilient members (13) has a diameter ranging from 6.0 mm to 7.0 mm.

9. The waterproof electrical connector of claim 1, wherein the electrical connector terminal (10) is integrally formed of a metal plate and has a gap (18) formed between each of two lateral sides of each said resilient member (13) and a corresponding one of two lateral sides of a corresponding said opening (14), and each said resilient member (13) has a bent portion (133) between the connected end (131) and the free end (132), and the bent portion (133) has a bent configuration to enhance the structural strength of the resilient member (13).

* * * * *